US007093565B2

(12) United States Patent
Robison

(10) Patent No.: US 7,093,565 B2
(45) Date of Patent: Aug. 22, 2006

(54) HEAT TRAP

(75) Inventor: David L. Robison, Ashtabula, OH (US)

(73) Assignee: Perfection Corporation, Madison, OH (US)

( * ) Notice: Subject to any disclaimer, the term of this patent is extended or adjusted under 35 U.S.C. 154(b) by 67 days.

(21) Appl. No.: 10/944,961

(22) Filed: Sep. 20, 2004

(65) Prior Publication Data

US 2005/0139171 A1 Jun. 30, 2005

Related U.S. Application Data

(60) Provisional application No. 60/523,852, filed on Nov. 20, 2003.

(51) Int. Cl.
*F22B 5/04* (2006.01)

(52) U.S. Cl. ..... 122/14.31

(58) Field of Classification Search ..... 122/14.31, 122/14.3; 137/496, 515, 515.3, 515.5, 515.7, 137/590, 592
See application file for complete search history.

(56) References Cited

U.S. PATENT DOCUMENTS

| | | | | |
|---|---|---|---|---|
| 1,173,620 | A | 2/1916 | Thompson | |
| 1,365,856 | A | 1/1921 | Sandlin | |
| 3,055,086 | A | 9/1962 | Hoganson | |
| 3,059,667 | A | 10/1962 | Coceano | |
| 3,796,230 | A | 3/1974 | Meripol | |
| 4,286,573 | A | 9/1981 | Nickel | |
| 4,465,102 | A | 8/1984 | Rupp | |
| 4,633,853 | A | 1/1987 | Prill et al. | |
| 4,741,679 | A | 5/1988 | Blassingame | |
| 4,964,394 | A | 10/1990 | Threatt | |
| 5,277,171 | A | 1/1994 | Lannes | |
| 5,577,491 | A | 11/1996 | Lewis | |
| 5,620,021 | A | 4/1997 | Hugo | |
| 5,794,661 | A | 8/1998 | Natalizia | |
| 6,269,780 | B1 | 8/2001 | Hughes | |
| 6,302,063 | B1 | 10/2001 | Schimmeyer | |
| 6,745,723 | B1 * | 6/2004 | Hicks et al. | 122/14.31 |
| 6,851,395 | B1 * | 2/2005 | Knaus | 122/14.31 |
| 2004/0055544 | A1 | 3/2004 | Knaus | |

* cited by examiner

*Primary Examiner*—Gregory Wilson

(57) ABSTRACT

A heat trap assembly for a hot water tank includes a heat trap insert and a sealing member retained by the heat trap insert. The heat trap insert includes a seat having an opening that is dimensioned to be covered by the sealing member when no water is flowing through the assembly. The heat trap insert also includes a plurality of fingers to retain the sealing member when water is flowing through the heat trap assembly.

20 Claims, 5 Drawing Sheets

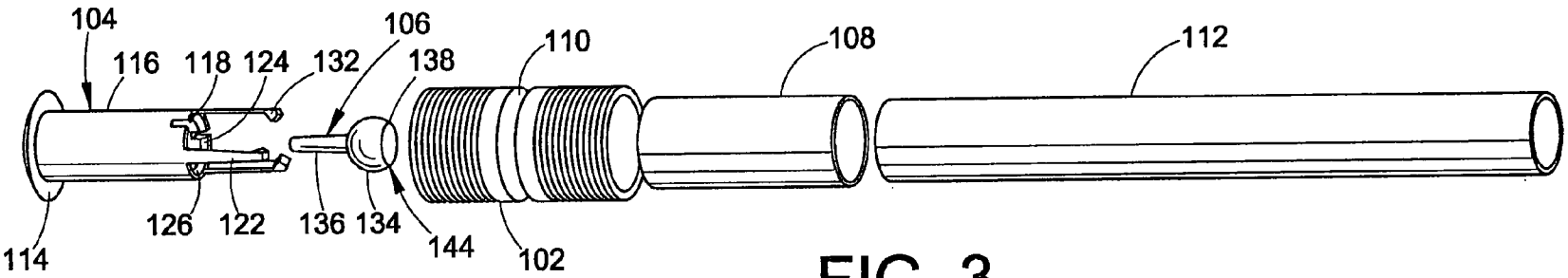
FIG. 3
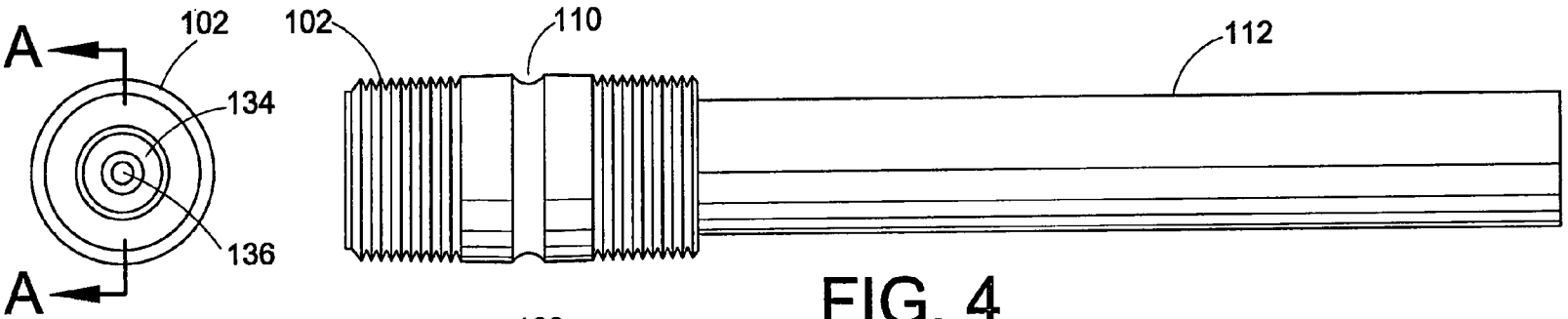
FIG. 4
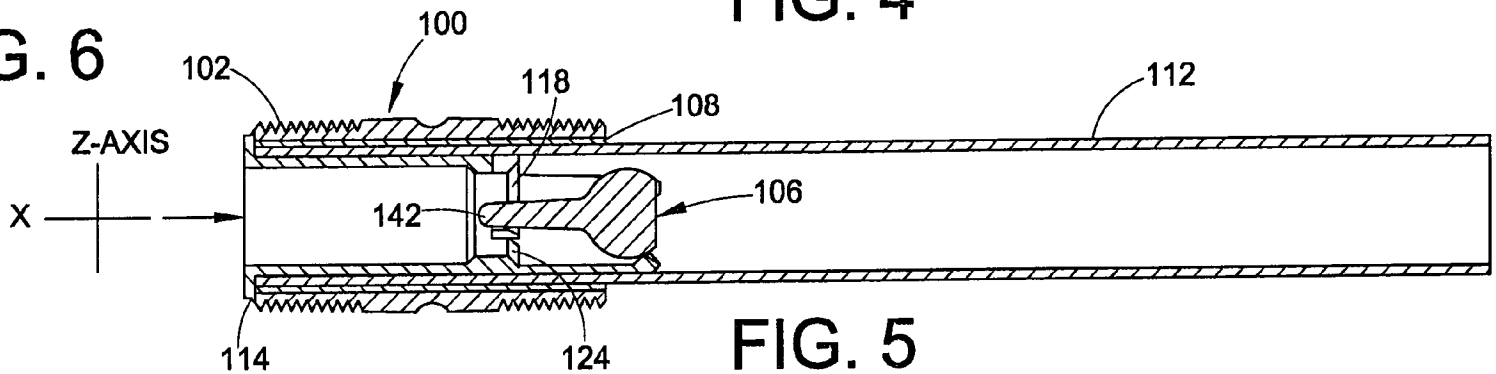
FIG. 5
FIG. 6

HEAT TRAP

This application claims the benefit of U.S. Provisional Patent Application Ser. No. 60/523,852, filed Nov. 20, 2003, entitled "HEAT TRAP," which is incorporated by reference.

BACKGROUND OF THE INVENTION

Referring to FIG. 1, a hot water heater assembly 10 generally includes a tank 12 including a heating element (not shown), a cold water inlet pipe 14 and a hot water outlet pipe 16. As the hot water is turned on, for example the hot water spigot in a household, hot water exits through the hot water outlet pipe 16 while cold water flows through the cold water inlet 14 into the tank 12. The amount of hot water leaving the tank equals the amount of cold water replaced and heated in the tank.

Considerable heat is lost through the water inlet and outlet piping of a water heater. The heat loss is due primarily to thermal circulation and not as a result of conduction through the piping itself.

FIG. 2 displays a prior art attempt to control the heat lost through the water inlet and the water outlet piping of the water heater. A prior art cold water inlet heat trap assembly 20 includes a nipple 22, a seat 24, a cage 26, and a ball 28. The nipple 22 is received in the inlet 30 of the tank 12 and also received in the outlet 32 of the cold water inlet pipe 14. The nipple provides the housing for the heat trap assembly 20. The seat 24 is formed inside the nipple. The seat includes an opening having a diameter smaller than the diameter of the ball 28. The cage 26 is a cage-like structure that traps the ball inside the nipple as water from the inlet pipe 14 flows through the nipple 22 into the tank 12. The ball 28 has a specific gravity less than 1.0 so that when no water is flowing through the cold water inlet pipe and the nipple into the tank the ball floats up to cover the opening at the seat.

In use, the hot water is turned on somewhere in the household, or wherever the tank is located. Almost simultaneously, hot water exits the hot water tank 12 through the hot water outlet pipe 16 and cold water enters the tank 12 through cold water inlet pipe 14. As cold water flows through the nipple 22, the water dislodges the ball 28 from the seat 24 and the ball moves toward the cage 26. The cage 26 catches the ball and retains the ball inside the nipple. The cage has openings to allow the water to flow around the ball and enter the tank 12. When the hot water is turned off, the ball 28 floats upwardly back towards and into engagement with the seat 24 trapping heat below it.

A similar hot water heat trap assembly 40 is provided on the hot water outlet pipe 16. The heat trap assembly 40 includes a nipple 42, a seat 44, a cage 46, and a ball 48. The nipple 42 is received in the inlet 50 of the hot water outlet pipe 16 and in the outlet 52 of the tank 12. The seat 44 and the cage 46 are of the same or similar construction of the seat 24 and the cage 26 of the cold water heat trap assembly 20. In the hot water heat trap assembly 40, the seat 44 and the cage 46 are disposed on opposite ends of the heat trap assembly as compared to the cold water heat trap assembly 20. The ball 48 of the hot water heat trap assembly 40 has a specific gravity greater than 1.0. Accordingly, when the hot water exits the tank 12 into the nipple 42, the ball 48 is dislodged from the seat 44 and retained by the cage 46. The cage has openings to allow water to pass around the ball and through the nipple. When the hot water is turned off in the household, no hot water is flowing through the nipple 42 and the hot water outlet pipe 16 so that the ball 48 sinks toward and into engagement with the seat 44 trapping heat below.

A problem with the above-mentioned energy saving device involves "chatter" of the balls 28 and 48 inside the nipples 22 and 42. Because the diameter of the nipple required to allow the ball to float freely inside the nipple and the influence of water flowing through the nipple, the balls tend to rotate at a relatively high speed. The high speed rotation of the balls allows the ball to contact the nipple and "chatter" making an audible sound that is noticeable to those standing near the water heater. To some consumers, this is considered objectionable, although it does not represent a defect in the heat trap. Accordingly, it is desirable to provide a heat trap assembly that provides the same or better energy efficiency of the prior art heat traps while also eliminating the "chatter" that accompanies such heat trap assemblies.

SUMMARY OF THE INVENTION

A heat trap assembly for a hot water tank includes a heat trap insert and a sealing member retained by the heat trap insert. The heat trap insert includes a seat having an opening that is dimensioned to be covered by the sealing member when no water is flowing through the assembly. The heat trap insert also includes a plurality of fingers to retain the sealing member when water is flowing through the heat trap assembly.

BRIEF DESCRIPTION OF THE DRAWINGS

FIG. 3 is an exploded view of a heat trap assembly.

FIG. 4 is a side elevation view of the heat trap assembly of FIG. 3 attached to a dip tube of a hot water tank.

FIG. 5 is a side cross-section view of the heat trap assembly of FIG. 3.

FIG. 6 is an end elevation view of the heat trap assembly of FIG. 3.

DETAILED DESCRIPTION OF THE INVENTION

Figure 1:
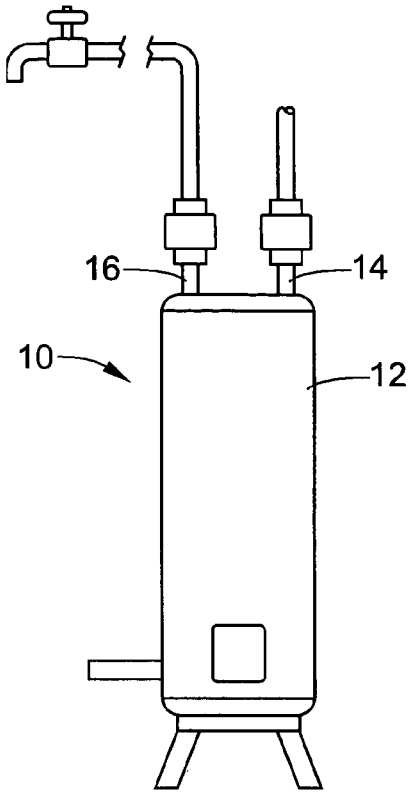
FIG. 1 PRIOR ART
FIG. 1 is a schematic view of a prior art hot water heater assembly.

It is to be understood that the specific devices and processes illustrated in the attached drawings, and described in the following specification are simply exemplary embodiments of the inventive concepts. Hence, specific examples and characteristics relating to the embodiments disclosed herein are not to be considered as limiting. Furthermore, for ease of illustration and comprehension the orientation of the heat trap assemblies is disclosed for a hot water heater assembly having inlet and outlet pipes located at the top to the heater. The heat trap assembly can also be used on hot water heater assemblies where the water enters at an alternative location, however the orientation and configuration of the components may need to be altered. The flow of the water through the heat trap assembly will control the location of certain components and the description that follows should not be deemed limiting as to certain hot water or cold water heat trap assemblies.

Referring to FIG. 3, a heat trap assembly 100 includes a nipple 102, a heat trap insert 104, a sealing member 106, and a liner 108. The heat trap insert, sealing member and liner of the heat trap assembly are made of a durable material, which in a preferred embodiment is plastic. The nipple is also made of a durable material, which in a preferred embodiment is metal.

Figure 2:
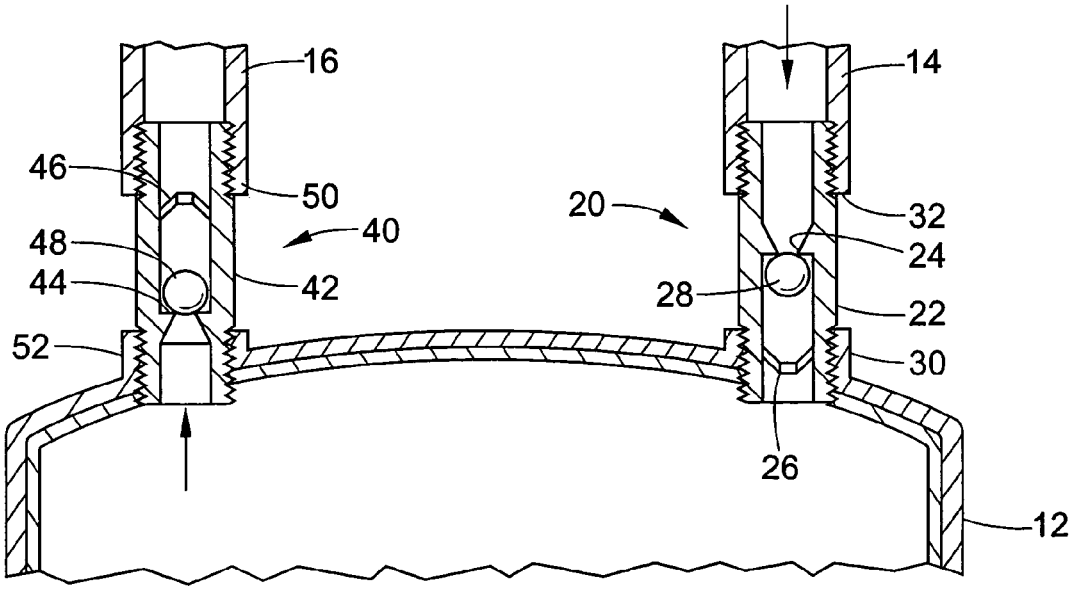
FIG. 2 PRIOR ART
FIG. 2 is a sectional view with parts in elevation of the upper portion of the hot water heater assembly of FIG. 1 disclosing a prior art heat trap assembly.

The nipple 102 receives the heat trap insert 104, the sealing member 106 and the liner 108. In a preferred embodiment, the nipple includes threads to attach the tank inlet 30 and the tank outlet 52 (FIG. 2). As seen in FIG. 4, a groove 110 is formed in a central portion of the nipple 102 to attach the nipple and the liner 108 to the dip tube 112. Typically, the dip tube 112 extends into the water heater to deliver the cold water to near the bottom of the water heater. The diameter of the nipple 102 is slightly larger than the diameter of the sealing member 106. The nipple 102 is depicted as attached to the dip tube 112; however, the heat trap assembly can also attach to the outlet pipe of the hot water tank in a manner to be described below.

The heat trap insert 104 includes a flanged end 114, a tubular portion 116, a seat 118 and fingers 122. The heat trap insert can be made from one piece of material, for example the heat trap insert can be one molded piece of plastic. The flanged end 114 abuts an end of the nipple 102 (see FIG. 5) and the remainder of the heat trap insert 104 is inserted into the nipple. The tubular portion 116 is hollow to define a fluid passage and extends from the flanged end 114 and terminates with the seat 118 opposite the flanged end.

Figure 7:
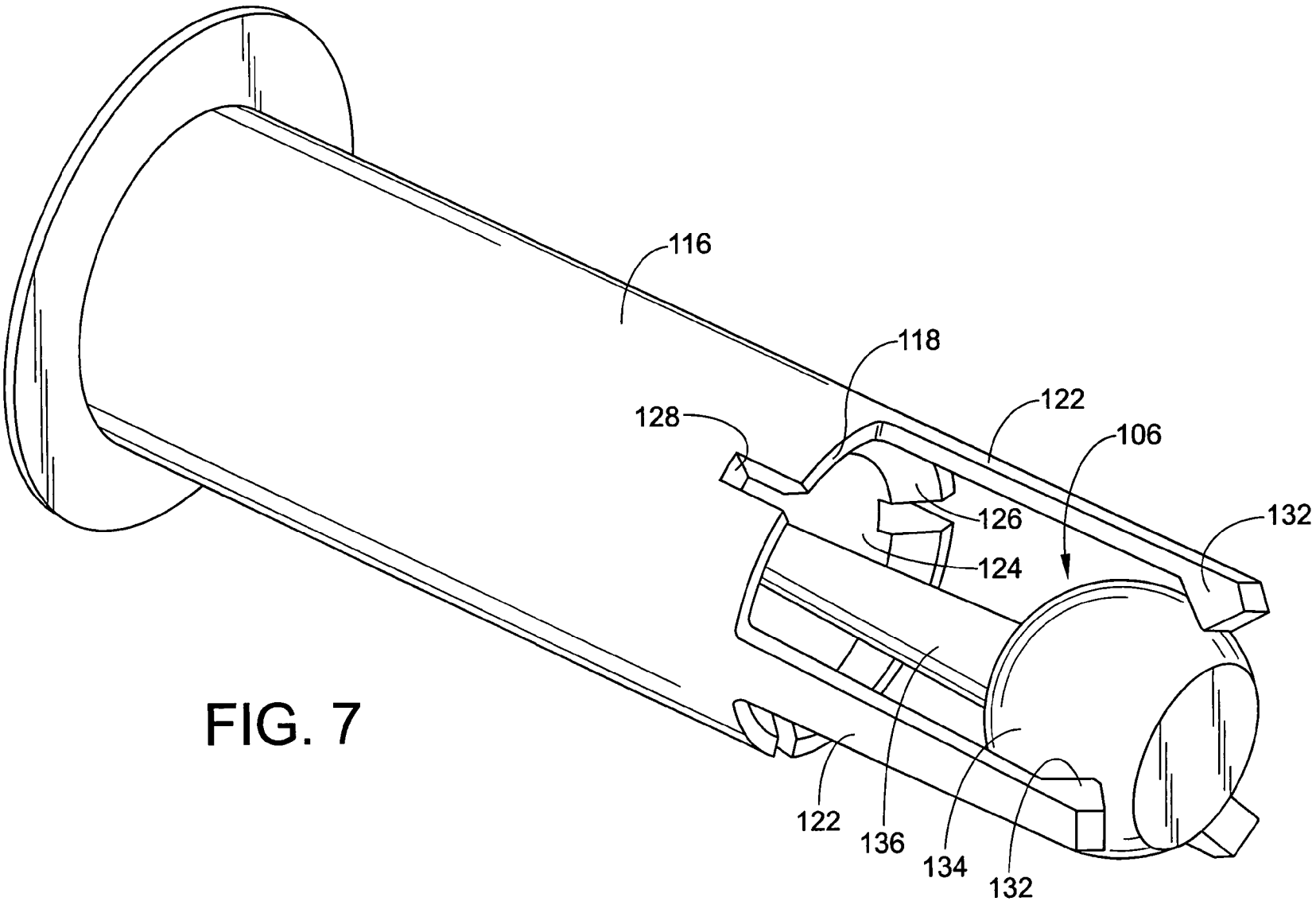
FIG. 7 is a perspective view of the assembled heat trap assembly of FIG. 3.

Referring to FIG. 7, the seat 118 defines an opening 124 having a diameter smaller than the greatest diameter of the sealing member 106. The seat also includes a beveled ledge 126 surrounding the opening. The beveled ledge allows a more secure fit for the sealing member 106 when it is seated on the seat. In a cold water heat trap assembly the seat is situated above the fingers 122. In a hot water heat trap assembly the seat is situated below the fingers 122. Notches 128 can also be formed in the tubular portion 116 around the seat 118.

Three fingers 122 extend from the tubular portion 116 of the heat trap insert 104 near the seat 118. The fingers 122 extend parallel to a longitudinal axis of the tubular portion 116 of the heat trap insert 104. Although three fingers are shown situated 1200 apart from one another, a greater or fewer number of fingers can be provided. The fingers 122 include catches 132 at an end of each finger opposite the seat 118 that extend toward the longitudinal axis of the tubular portion 116 of the heat trap insert 104. The catches 132 retain the sealing member 106 inside the heat trap insert 104 as water flows through the assembly. The catches can be triangular in shape or another suitable configuration. The fingers 122 are resilient so that the sealing member 106 can be inserted into the heat trap insert 104 prior to insertion of the heat trap insert 104 into the nipple 102 or other pipe. The nipple 102 or other pipe confines the movement of the fingers 122 so that the fingers retain the sealing member 106 as water flows through the assembly.

The sealing member 106 includes a substantially spherical portion 134 and a tail portion 136 giving the sealing member a generally tadpole-shaped configuration. The sealing member is designed so that it will rotate very little or not at all as water passes through the assembly. In a hot water heat trap assembly, the sealing member has a specific gravity greater than 1.0. In a cold water heat trap assembly the sealing member has a specific gravity less than 1.0. The spherical portion 134 of the sealing member has a diameter larger than the diameter of the opening 124 of the seat 118. The sealing member also has a substantially flat portion 138 axially aligned with the tail portion. In lieu of having a substantially spherical configuration, the spherical portion could take another configuration. An alternative configuration would allow the sealing member 106 to at least substantially cover the inlet or the outlet of the assembly 100 so that heat is not lost from the hot water tank into the water held in the attached piping.

The tail portion 136 extends from the spherical portion 134 of the sealing member 106. The tail portion 136 is frusto-conical in configuration tapering away from the spherical portion 134. Alternatively, the tail portion can be cylindrical, or another suitable shape. As seen in FIG. 5, the length of the tail portion 136 and the fingers 122 is such that an end 142 of the tail portion 136 of the sealing member 106 does not leave the opening 124 of the seat 118 when the sealing member 106 contacts the catches 132 of the fingers 122.

The sealing member can also include a post so that the sealing member would be similarly shaped to the sealing member disclosed in co-pending U.S. patent application Ser. No. 10/644,201 filed on Aug. 20, 2003, which is incorporated herein by reference. The post can be positioned slightly off-center from a central axis of the sealing member 106. The post is a protruding stud disposed substantially opposite the tail portion 136. The length of the post is such that the post catches or engages one of the fingers 122 and/or catches 132 when water is flowing through the nipple 102. Referring to FIG. 5, the liner 108 is interposed between the nipple 102 and the dip tube 112.

Figure 8:
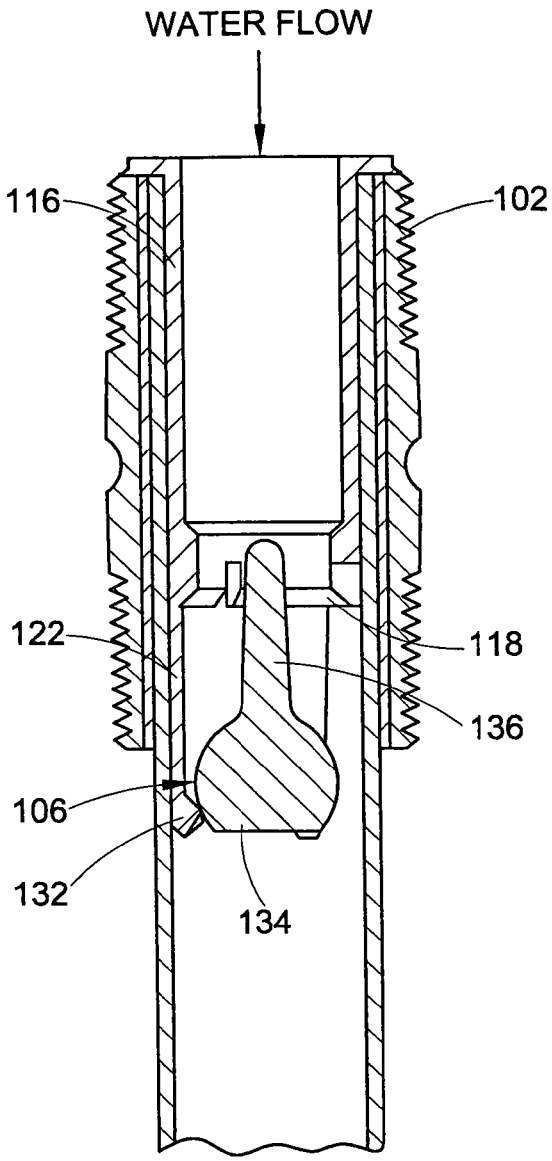
FIG. 8 is a cross-section of the heat trap assembly of FIG. 3 attached to a cold water inlet.
Figure 9:
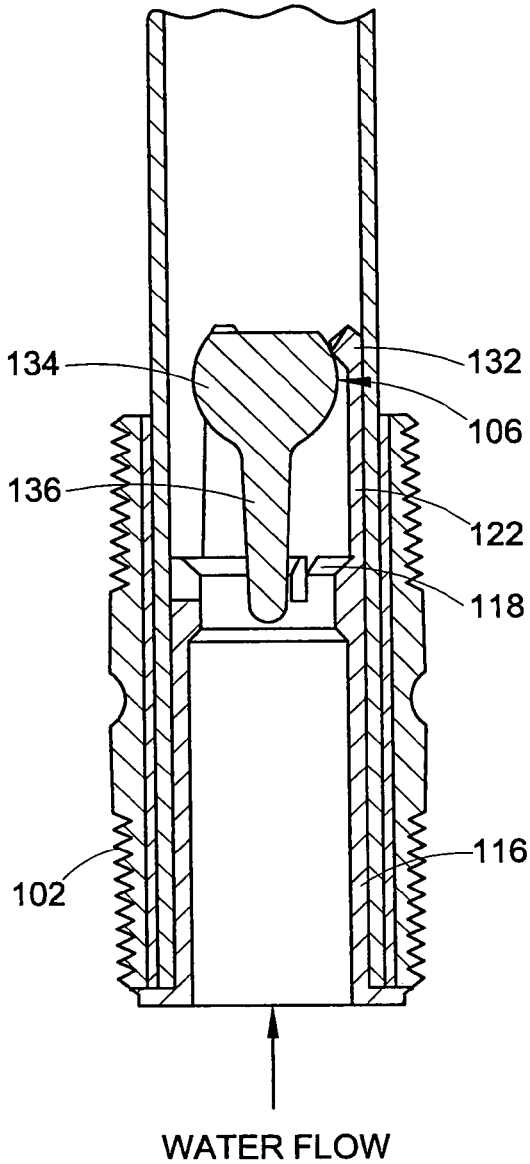
FIG. 9 is a cross-section of the heat trap assembly of FIG. 3 attached to a hot water outlet.

Referring to FIG. 5, the sealing member 106 is trapped between the seat 118 and the catches 132 of the fingers 122. With no water flowing through the assembly 100, the sealing member 106 is seated on the seat 118, thus trapping heat below or above, depending on whether the assembly 100 is used with a hot water pipe or a cold water pipe. When attached to a conventional cold water inlet in the manner shown in FIG. 8, the sealing member 106 floats up to rest in the seat 118. When attached to the hot water outlet in the manner shown in FIG. 9, the sealing member 106 sinks down to rest in the seat 118. As the water enters the heat trap insert 102 of FIG. 8 the sealing member 106 moves towards the catches 132 of the fingers 122. The catches 132 retain the sealing member 106 as water flows through the assembly. The water flows around the sealing member 106 and through the spaces between the fingers 122 and out of the assembly. The tail portion 136 of the sealing member 106 does not exit the opening 124 of the seat 118 when the sealing member contacts the catches 132. Since the tail 134 does not leave the opening 124 of the seat 118 when the sealing member 106 is caught by the fingers 122, i.e., when water is flowing through the assembly, the spherical portion 134 can move towards the seat and the tail 134 will not catch the seat 118 obstructing the movement of the sealing member.

The sealing member 106 is restricted from rotation and inhibited from rattling against the heat trap insert 102 when water is flowing through the assembly. The tail portion 136 of the sealing member 106 restricts rotation about the Y-axis (which is coming out of the page in FIG. 5) and the Z-axis. Rotation about the Y-axis and the Z-axis may be further restricted by the end 142 of the tail portion 136 resting against the seat 118. Rotation about the X-axis is restricted by the water flowing around the spherical portion 134 through the spaces between the fingers 122. Thus, the tadpole shape of the sealing member 106 limits rotational movement of the sealing member. The optional protruding post 144 of the sealing member 106 can further restrict rotation about the X-axis where the post catches a finger 122 and/or catch 132.

Figure 10:
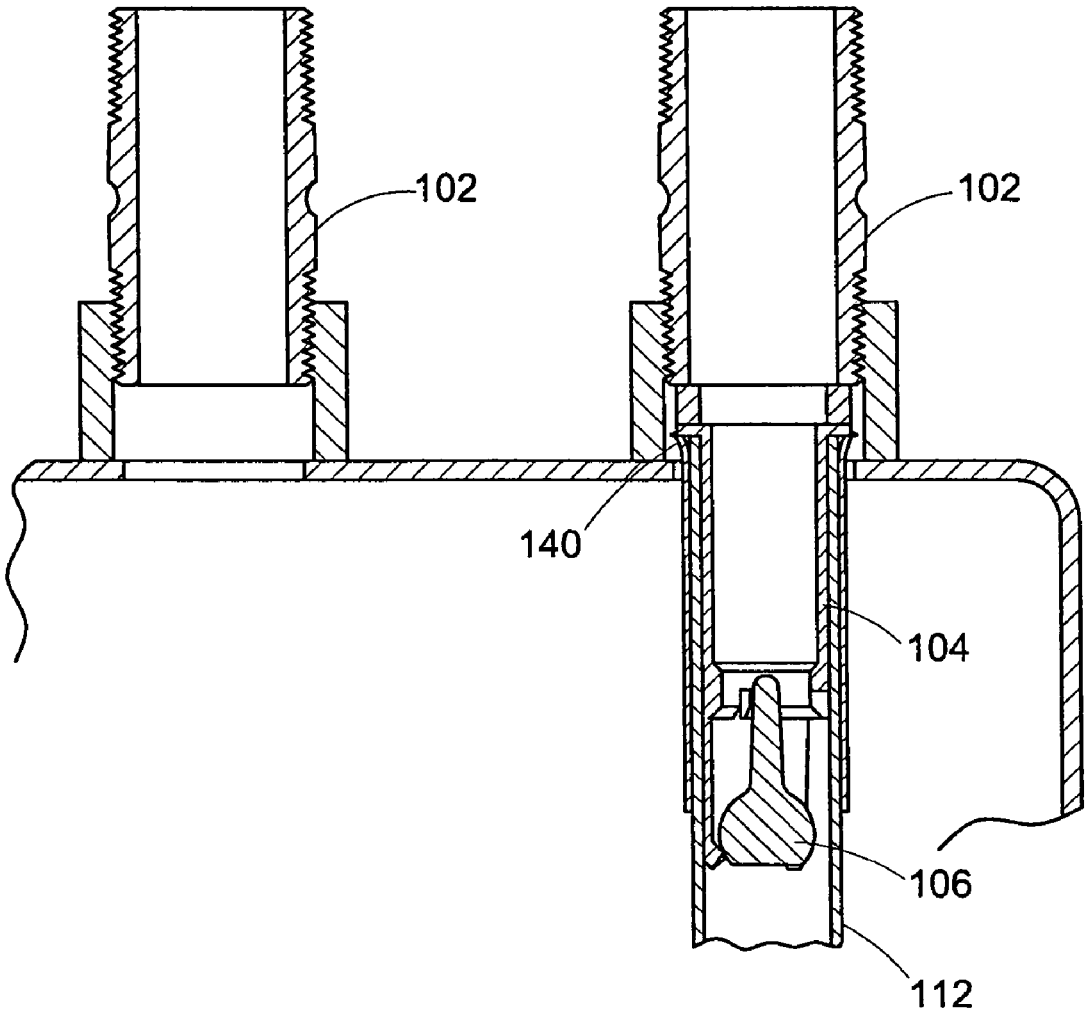
FIG. 10 is a sectional view with parts in elevation of the upper portion of a hot water tank showing a dip tube extending into the tank and the heat trap assembly of FIG. 7 inserted into the dip tube.

The heat trap assembly need not include a nipple in every installation. As just one example, with reference to FIG. 10, the heat trap insert 104 is inserted into the dip tube 112 and the nipple can attach above the dip tube. Such a configuration is particularly desirable for hot water tanks where the dip tube and the hot water tank are shipped unattached to one another. In many instances, the dip tube includes a flange 140 that rests against the top of the water heater. The nipple is attached in the field with the dip tube previously inserted into the hot water tank during manufacture. Accordingly, in this configuration the nipple does not house the heat trap insert 104 or the other components of the heat trap assembly.

A heat trap assembly having the desired energy efficiency is provided without having the accompanying unwanted "chatter". The assembly has been described with reference to a preferred embodiment. Obviously, modifications and alterations will occur to others upon reading and understanding the preceding detailed description. It is intended that the invention described be construed to include all reasonable modifications and alterations that come within the scope of the appended claims and the equivalents thereof.

The invention claimed is:

1. A heat trap assembly for a hot water heater, the assembly comprising:

a sealing member; and an insert receiving the sealing member, the insert comprising a seat, fingers extending away from the seat, and at least one catch disposed on at least one of the fingers, the at least one catch extending towards a longitudinal axis of the insert wherein at least one of the fingers and the at least one catch retain the sealing member when water is flowing through the insert.

2. The assembly of claim 1, wherein the fingers extend from the seat in a direction at least substantially parallel to a longitudinal axis of the insert.

3. The assembly of claim 1, wherein the sealing member comprises an at least substantially spherical portion and a tail portion extending from the at least substantially spherical portion.

4. The assembly of claim 1, wherein each finger extends from the seat a distance less than the greatest length of the sealing member.

5. The assembly of claim 1, wherein the insert comprises a flange disposed at an end of the insert opposite the fingers.

6. The assembly of claim 1, wherein the fingers are flexible.

7. The assembly of claim 6, further comprising a nipple receiving the insert.

8. A heat trap assembly for a hot water heater, the assembly comprising:

a one-piece insert adapted to be received in an associated pipe or nipple, the insert including a side wall, a seat and at least two fingers, wherein the side wall defines a fluid passage, and wherein the fingers extend from the side wall and are circumferentially spaced from one another; and a sealing member including an at least substantially spherical portion and a tail portion extending from the at least substantially spherical portion, the sealing member being disposed in the insert and movable between a first position where the sealing member rests against the seat and a second position where the sealing member is retained by the fingers such that fluid travels through the fluid passage and exits the insert around the sealing member via a space defined between the fingers and the associated pipe or nipple.

9. The assembly of claim 8, wherein the side wall is at least substantially cylindrical.

10. The assembly of claim 8, wherein the fingers extend from the side wall in a direction that is substantially parallel to a longitudinal axis of the insert.

11. The assembly of claim 8, wherein the fingers terminate at ends that are spaced from one another.

12. The assembly of claim 8, wherein the side wall terminates at one end at the seat.

13. The assembly of claim 12, further comprising a flange disposed at or adjacent an end of the side wall opposite the seat.

14. The assembly of claim 8, wherein the insert and the sealing member are shaped such that the tail portion remains in an opening defined by the seat when the sealing member is in the second position.

15. A heat trap assembly comprising:

a sealing member; and an insert configured to be received in an associated pipe or nipple, the insert being a single molded piece comprising a seat and fingers extending away from the seat, the sealing member resting against the seat when no fluid is flowing through the insert and the sealing member being retained by the fingers when fluid travels through the insert, the insert being flexible to allow the sealing member to be inserted into the insert prior to the insert being received in the associated pipe or nipple, the associated pipe or nipple confining the movement of the insert when the insert is received by the associated pipe or nipple to retain the sealing member as water flows through the insert.

16. The assembly of claim 15, wherein the fingers are flexible to allow the sealing member to be inserted into the insert prior to the insert being received in the associated pipe or nipple.

17. The assembly of claim 16, wherein the fingers terminate at ends that are spaced from one another.

18. The assembly of claim 17, wherein each finger includes a catch disposed at an end.

19. The assembly of claim 15, wherein the sealing member includes a spherical portion and a tail extending from the spherical portion.

20. The assembly of claim 15, wherein the insert includes at least one notch formed adjacent the seat, the notch running generally parallel with a central axis of the insert.

* * * * *